US007703815B2

(12) United States Patent
Berkseth et al.

(10) Patent No.: US 7,703,815 B2
(45) Date of Patent: Apr. 27, 2010

(54) QUICK CAM LATCH MECHANISM

(75) Inventors: John K. Berkseth, Rice Lake, WI (US); Michael W. Kondratuk, Cameron, WI (US)

(73) Assignee: Hardware Specialties, Inc., Spooner, WI (US)

( * ) Notice: Subject to any disclaimer, the term of this patent is extended or adjusted under 35 U.S.C. 154(b) by 0 days.

(21) Appl. No.: 11/177,069

(22) Filed: Jul. 8, 2005

(65) Prior Publication Data

US 2007/0007773 A1 Jan. 11, 2007

(51) Int. Cl.
*E05C 1/12* (2006.01)

(52) U.S. Cl. ..... 292/164; 292/169; 292/165

(58) Field of Classification Search ..... 292/164, 292/165, 167, 170, 169, 169.17, 173, 159, 292/169.14, 1.5, 140, 143, 163
See application file for complete search history.

(56) References Cited

U.S. PATENT DOCUMENTS

| | | | | |
|---|---|---|---|---|
| 215,580 | A | 5/1879 | Daniels | |
| 231,260 | A | 8/1880 | Billings | |
| 887,690 | A | 5/1908 | Pearce | |
| 2,222,411 | A * | 11/1940 | Kaiser | 292/165 |
| 2,988,389 | A * | 6/1961 | Wilson | 292/165 |
| 3,233,439 | A * | 2/1966 | Papas | 70/152 |
| 3,782,139 | A | 1/1974 | Rubner | 70/81 |
| 4,741,563 | A | 5/1988 | Cohrs | 292/21 |
| 4,974,883 | A * | 12/1990 | Jans | 292/169 |
| 5,020,836 | A * | 6/1991 | Su | 292/165 |
| 5,205,596 | A | 4/1993 | Ralph | 292/336.3 |
| 5,342,101 | A * | 8/1994 | Shih | 292/165 |
| 5,620,214 | A | 4/1997 | Kondratuk | 292/217 |
| 5,651,568 | A | 7/1997 | Fortune | 292/140 |
| 5,690,372 | A | 11/1997 | Jans | 292/169 |
| 6,526,787 | B2 * | 3/2003 | Ming-Chih | 70/107 |
| 6,536,248 | B1 | 3/2003 | Fan | 70/467 |
| 7,390,035 | B2 * | 6/2008 | Karcz et al. | 292/163 |
| 2004/0084909 | A1 * | 5/2004 | Kondratuk | 292/169 |

* cited by examiner

*Primary Examiner*—Carlos Lugo
*Assistant Examiner*—Mark Williams
(74) *Attorney, Agent, or Firm*—Moss & Barnett

(57) ABSTRACT

A quick cam latch mechanism having an operatively coupled bolt and cam assembly disposed in a latch housing. A handle is coupled to the cam assembly for moving the bolt between an extended or engaged position and a retracted or disengaged position. The cam assembly includes a primary cam operatively coupled to a secondary cam or linkage that is in turn operatively coupled to the bolt. Rotation of the primary cam translates into increased pivoting of the linkage and thereby increased retraction of the bolt. As a result, less rotation of primary cam is needed to retract the bolt. In an example embodiment of the invention, at least two linkages are utilized to quickly retract the bolt regardless of the direction of rotation of the handle.

15 Claims, 10 Drawing Sheets

QUICK CAM LATCH MECHANISM

BACKGROUND OF THE INVENTION

1. Field of the Invention

The present invention is directed to a latch for mounting to a door and in particular to a rotary type latch that requires less handle rotation during operation.

2. Description of the Related Art

Latches mounted to or within a door are well known and typically include a latch housing and bolt. In one common type of latch, the bolt is typically operatively coupled or connected to a handle. Rotation of the handle in either a clockwise or counterclockwise direction draws or retracts the bolt into the housing. The bolt is retractable into the housing to permit the door to swing freely. In its extended position, the bolt is adapted to strike and engage a strike plate thereby preventing free movement of the door.

The handle acts on a cam operatively disposed within the housing which in turn acts upon and retracts the bolt. The handle of the conventional latches had to be rotated approximately 60 degrees in either direction in order to fully retract the bolt and permit free movement of the door. More recent devices, however, have been developed that utilize a secondary cam to increase the rate at which the bolt retracts into the housing. One such devise is illustrated in U.S. Pat. No. 5,690,372 to Jans. Devises of this type have an advantage of retracting the bolt more quickly into the housing with less rotation of the handle. However, they have the disadvantage of being complicated and difficult to manufacture.

What is needed in the lock and latch industry is a rotatable latch that utilizes a novel cam assembly to quickly retract a bolt into a latch housing by rotating a latch handle generally less than 60 degrees. What is also needed in the lock and latch industry is a rotatable latch utilizing an uncomplicated, yet novel cam assembly to draw the bolt into the housing.

SUMMARY OF THE INVENTION

Example embodiments of the invention relate to a latch mechanism that retracts a bolt by rotation of a handle less than 60 degrees. The invention includes a bolt slideably mounted in a latch housing that can be mounted either on or in a door. The handle for retracting the bolt extends into and/or through the housing to engage a primary cam and at least one secondary cam or linkage. The linkage is disposed generally between and operatively coupled to the bolt and the primary cam. Rotation of the handle in turn rotates the primary cam which engages and directly rotates the linkage. The linkage in turn engages and retracts the bolt at an accelerated rate.

In another example embodiment of the invention, a handle-spindle assembly is utilized to rotate or pivot primary cam such that rotation of the handle in turn rotates the spindle and concurrently the primary cam. As discussed above, the primary cam acts upon the linkage to retract or draw the bolt into the housing at an accelerated rate compared to the rate of rotation of the handle and the primary cam. Depending upon the type of handle utilized, when a user releases the handle it can be automatically extended, pivoted, rotated, or repositioned to a pre-actuated position with at least a portion of the bolt extending away from or out of the door.

In yet another example embodiment of the invention, the primary cam acts upon first and second linkages that quickly retract or draw the bolt into the housing depending upon the rotation or pivoting of the handle. Movement of the handle in a clockwise or first direction causes the primary cam to act upon the first linkage. Movement of the handle in a counter clockwise or second direction causes the primary cam to act upon the second linkage. In either direction the bolt is easily and quickly drawn into the housing.

It is an object of the present invention to provide a latch mechanism that is easy to use and inexpensive to manufacturer.

It is another object of the present invention to provide a bolt of a latch mechanism that has an increased rate of retraction compared to a rate of rotation of a handle.

It is yet another object of the present invention that rotation of the handle less than 60 degrees in either a clockwise or counterclockwise direction fully retracts the bolt into the housing.

The above summary of the invention is not intended to describe each illustrated embodiment or every implementation of the invention. Instead, the summary of the invention is provided to aid the reader in understanding the novel concepts illustrated or depicted in the following brief description of the drawings.

BRIEF DESCRIPTION OF THE DRAWINGS

The invention may be more completely understood in consideration of the following detailed description of various embodiments of the invention in connection with accompanying figures, in which.

Figure 1:
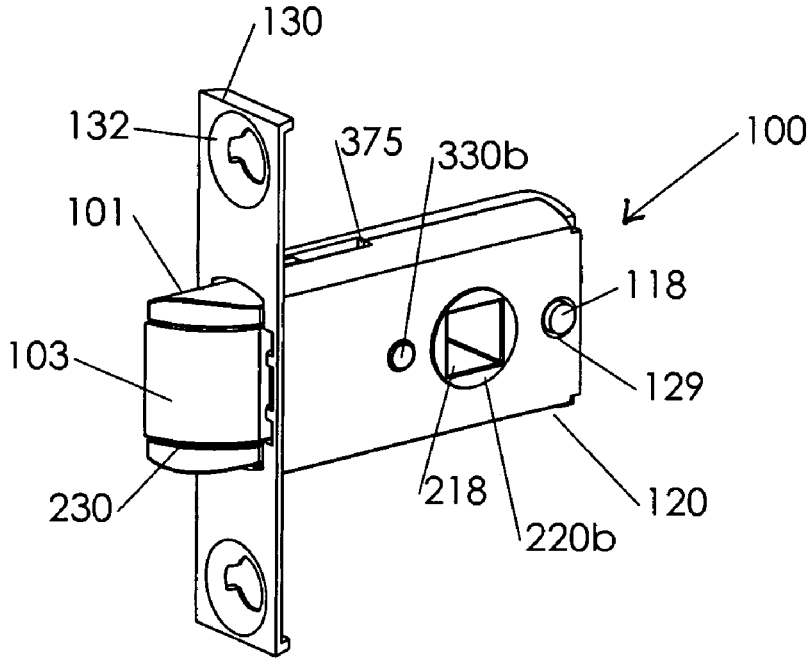
FIG. 1 is a first perspective view of a quick cam latch mechanism according to an example embodiment of the present invention.

While the invention is amendable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF PREFERRED EMBODIMENTS

FIGS. 1 through 14 collectively illustrate a quick cam latch mechanism, indicated by the numeral 100, to control the free movement of a door and/or window. An example embodiment of the invention, as illustrated in FIGS. 1-4, includes a bolt 101 operatively disposed to or within a latch housing 102 having an interior 104 defined by a side wall 106 (see FIG. 3), a top wall 108, a bottom wall 110, and rear wall 112 such that housing 102 includes a generally open side.

Referring to FIGS. 1-3 and 5, the interior 104 of housing 102 can be selectively covered by a cover 120 having a side wall 122 and top and bottom walls 124 and 126. As particularly illustrated in FIGS. 1 and 2, top wall 108 and bottom wall 110 of housing 102 are confrontable and/or mateable with top wall 122 and bottom wall 124 of cover 120 to selectively enclose at least a portion of the interior 104 of housing 102.

Referring to FIGS. 1-4, a face plate 130 is at least detachably coupled, mounted to or formed with housing 102 for securing housing 102 to or within a latch cavity of a door. Face plate 130 includes at least one fastener opening 132 for receiving a fastener used to fasten housing 102 to a portion of the door. In the example embodiments illustrated in FIGS. 1-4, face plate 130 includes a pair of spaced apart fastener openings. One skilled in the art will appreciate that face plate 130 can be adapted to receive a number of different fasteners such as, screws, security fasteners, and the like.

Figure 3:
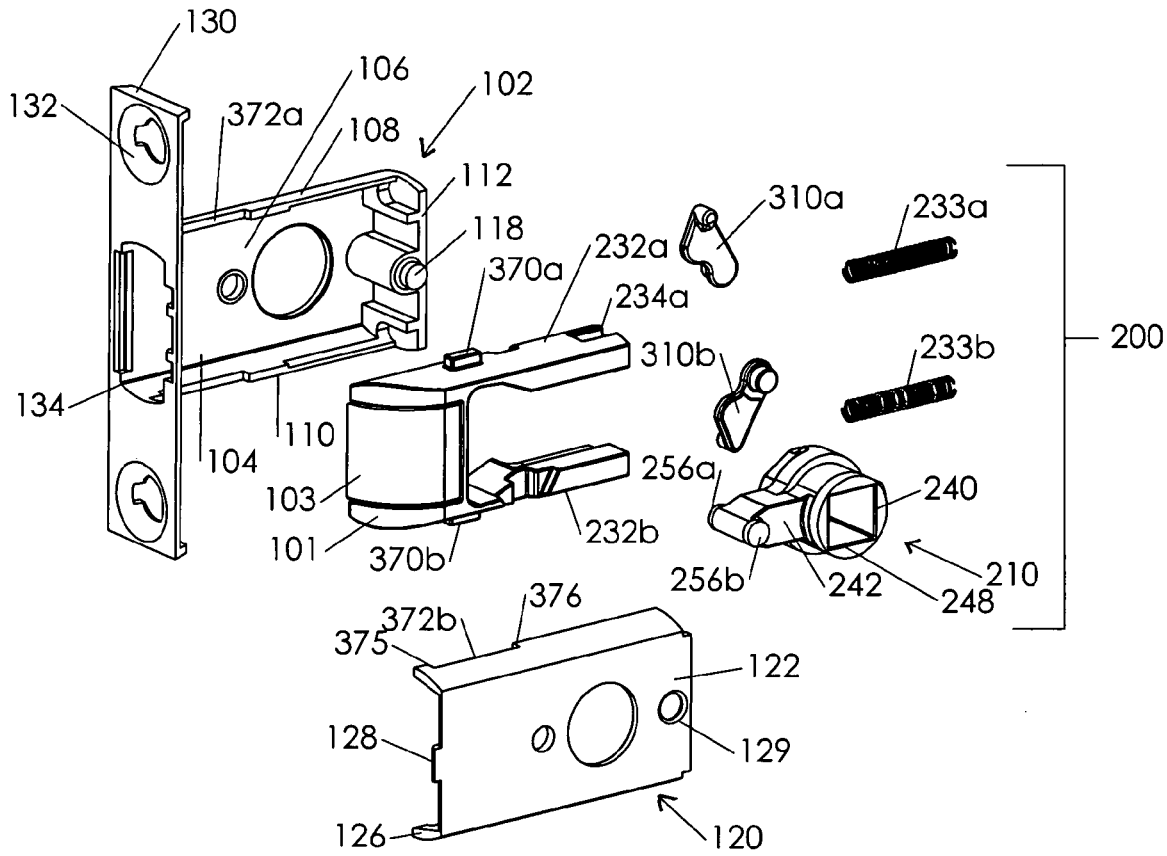
FIG. 3 is an exploded view of an example embodiment of the quick cam latch mechanism according to an example embodiment of the present invention.
Figure 4:
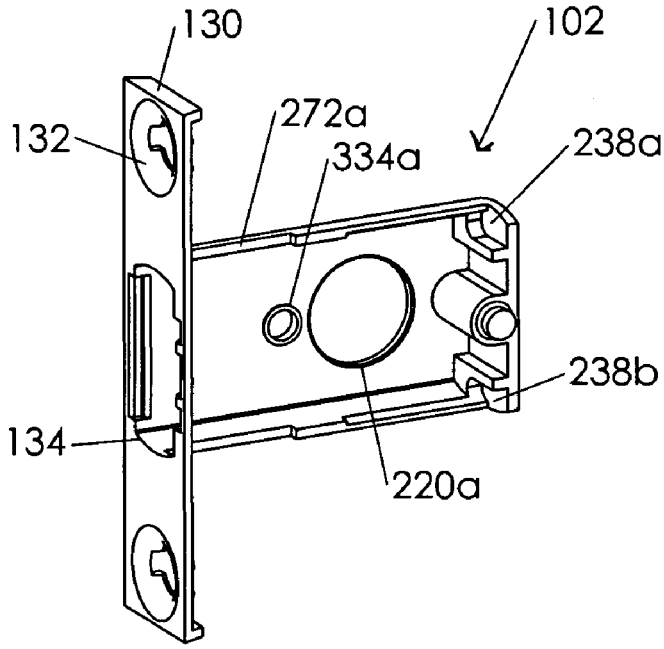
FIG. 4 is a perspective view of a housing according to an example embodiment of the present invention.
Figure 5:
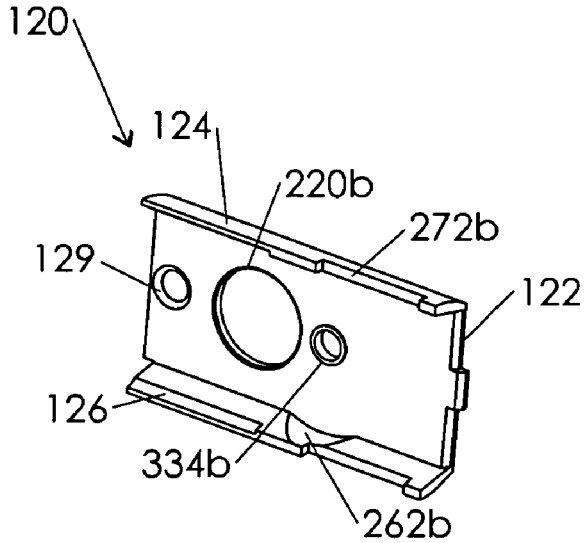
FIG. 5 is a perspective view of a cover according to an example embodiment of the present invention.

Referring to FIGS. 3-4, a bolt opening 134 is formed in or extends through face plate 130 for receiving bolt 101 as it travels between the extended and retracted positions. Bolt opening 134 is defined by a peripheral edge formed in face plate 130 having a shape adapted to permit free movement of bolt 101 in housing 102.

Referring to FIGS. 1-5, housing 102 and cover 120 can be coupled, secured and/or attached together by numerous methods, including, but not limited to, rivets, fasteners and/or inter-component engagement. Inter-component engagement, as illustrated in the example embodiments of FIGS. 1-5, can include cover 120 having a tongue, lip or the like 128 that is mateable with a portion of face plate 130. Face plate 130 can include a tongue opening or slit 136 formed therein for receiving and securing a front portion of cover 120 to housing 102. Cover 120 can also include a boss opening 129 extending therethrough for receiving at least one boss 118 formed on or adjacent to an inner surface of the rear wall 112 of housing 102. Boss 118 can be pressure fitted within boss opening 129 of cover 120 to secure the rear portion of cover 120 to housing 102. Other forms of inter-component engagement are also envisioned within the spirit and scope of the invention. Other types of engagement such as hinges and clasps, track and groove and the like are also considered to be within the scope and spirit of the invention.

Figure 2:
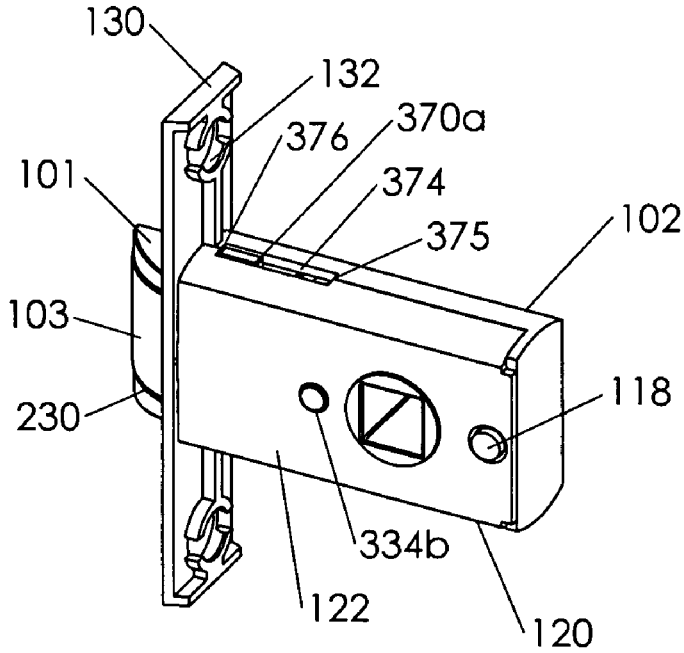
FIG. 2 is a second perspective view of the quick cam latch mechanism of FIG. 1 according to an example embodiment of the present invention.
Figure 6:
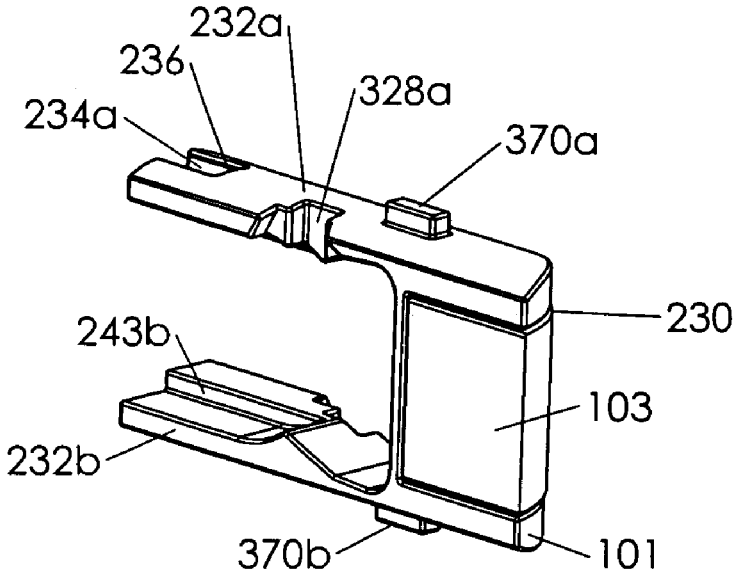
FIG. 6 is a perspective view of a latch bolt illustrating a first side surface thereof, according to an example embodiment of the present invention.
Figure 7:
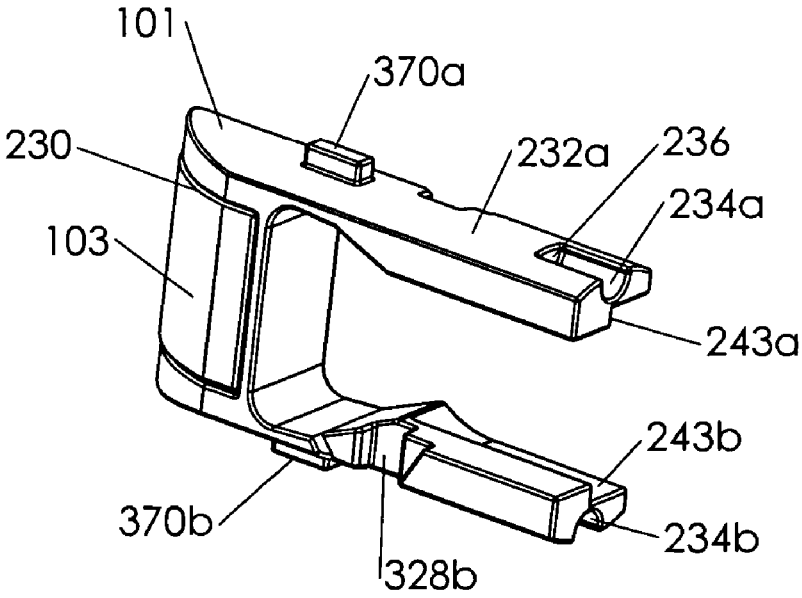
FIG. 7 is a perspective view of the latch bolt of FIG. 6 illustrating a second opposite side surface thereof.

Referring to FIGS. 3, and 11-14, enclosed or encased within the joined housing 102 and cover 120 is bolt 101 and a cam assembly 200 that is used to move bolt 101 between the retracted and extended positions. As illustrated in FIGS. 6 and 7, bolt 101 includes a tapering free end or engagement portion 230 and a pair of spaced leg portions 232*a* and 232*b* extending away from a rear or back of bolt 101. As illustrated in FIGS. 1 and 2, engagement portion 230 extends out of bolt opening 134 when bolt 101 is in the extended position. As particularly illustrated in FIG. 14, a free end of engagement portion 230 is positioned generally adjacent to face plate 130 when bolt 101 is in the retracted position.

Returning to FIGS. 6 and 7, a width of engagement portion 230 can taper generally from leg portions 232*a* and 232*b* toward the free end thereof. The tapering width of bolt 101 assists in the movement of bolt 101 from the extended position toward the retracted position upon engagement with a strike latch mounted on a door jamb. Engagement portion 230 can also have a generally uniform width such that bolt 101 is similar to a deadbolt. Other configurations of bolt 101 and its portions are also considered to be within the spirit and scope of the invention. Additionally, an engagement cover or wear surface 103 can be formed in or attached to bolt 101 to provide a bolt surface that reduces the amount of wear and/or resistance created by bolt 101 repeatedly engaging a strike latch mounted on a door jamb.

Referring now to FIGS. 3 and 11-14, cam assembly 200 is generally disposed between and operatively confronting leg portions 232*a* and 232*b* of bolt 101. In one example embodiment of the invention, cam assembly 200 can include a primary cam 210 that confronts or engages first cam 310*a* and/or secondary cam 310*b* that in turn confront or engage either one or both of leg portions 232*a* and 232*b* drawing bolt 101 from the extended position toward the retracted position.

Cam assembly 200 also includes at least one biasing member, means or spring that is operatively disposed between rear wall 112 of housing 102 and bolt 101 to bias bolt 101 in the extended position. In the example embodiments of FIGS. 3 and 11-14, a pair of biasing members 233*a* and 233*b* are disposed between and axially aligned with leg portions 232*a* and 232*b* respectively. As illustrated in FIGS. 3 and 7, leg portions 232*a* and 232*b* can include a channel or groove 234*a* and 234*b* formed therein for receiving biasing members 233*a* and 233*b*. Each of channels 234*a* and 234*b* includes an abutment surface 236 for abutting an end of each of the biasing members 233*a* and 233*b* disposed within the channels 234*a* and 234*b*. Opposed ends of the biasing members 234*a* and 234*b* can be disposed in catches 238*a* and 238*b* consisting of a generally curved or arcuate walls extending away from rear wall 112 of housing 102. When bolt 101 is disposed in housing 102, channels 234*a* and 234*b* and catches 238*a* and 238*b* are generally in registration with each other such that perpendicular or lateral movement of biasing members 233*a* and 233*b* is restricted.

Referring to FIGS. 3 and 8, primary cam 210 includes a body portion 240 and an arm portion 242 extending away therefrom that confronts or engages linkages 310*a* and/or 310*b*. The body portion 240 can have a generally cylindrical shape to reduce the amount of space needed in interior 104 of housing 102. The cylindrical shape of body portion 240 of primary cam 210 is to facilitate rotation or pivoting of primary cam either by a handle or handle spindle assembly. In another embodiment of the invention, primary cam 210 can also have the shape of an arm, rod or lever with one end pivotally coupled to at least the housing and/or cover. Primary cam 210 in this example embodiment pivots in either a clockwise or counterclockwise direction to engage linkages 310*a* and/or 310*b* which engage and quickly retract bolt 101.

Figure 8A:
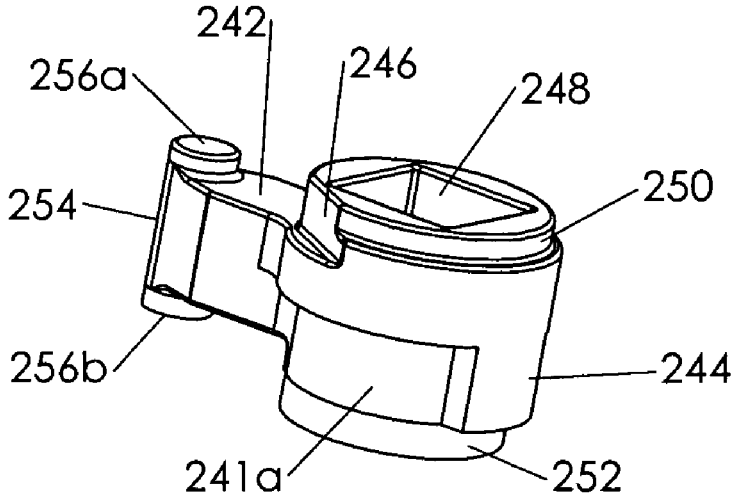
FIG. 8*a* is a perspective view of a primary cam according to an example embodiment of the present invention.
Figure 8B:
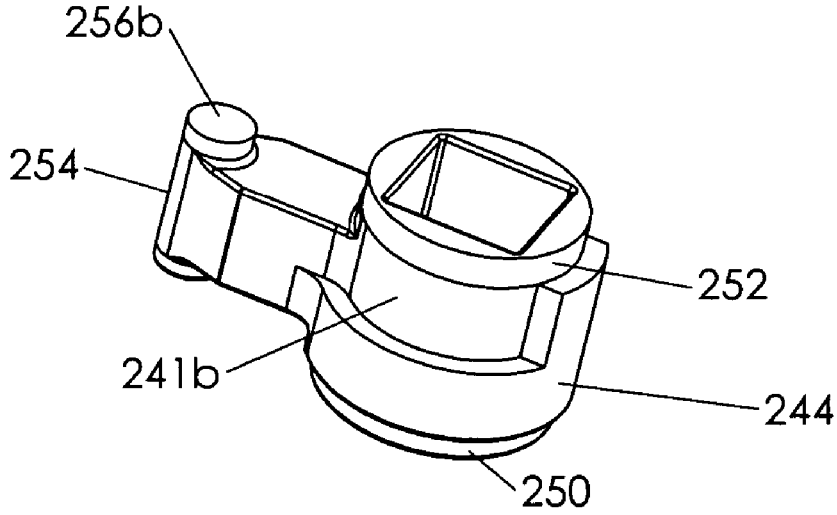
FIG. 8*b* is a perspective view of the primary cam of FIG. 8*a* illustrating a opposite side surface thereof.
Figure 9A:
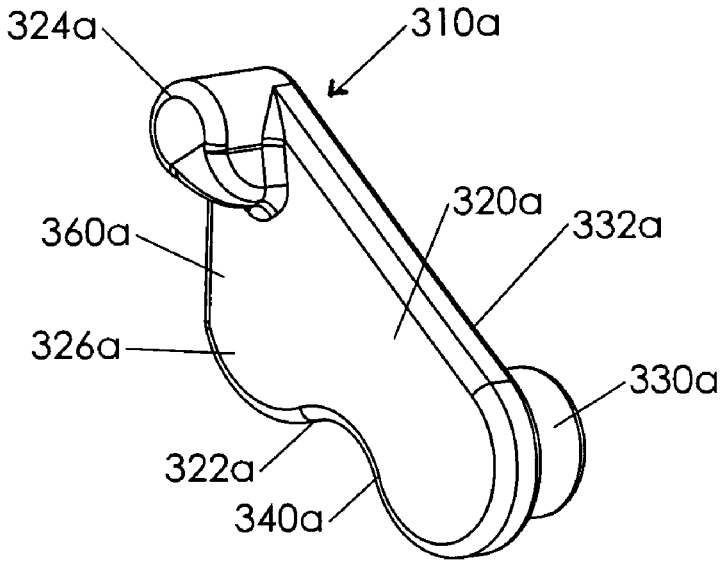
FIG. 9*a* is a perspective view of a secondary cam or linkage according to an example embodiment of the present invention.
Figure 9B:
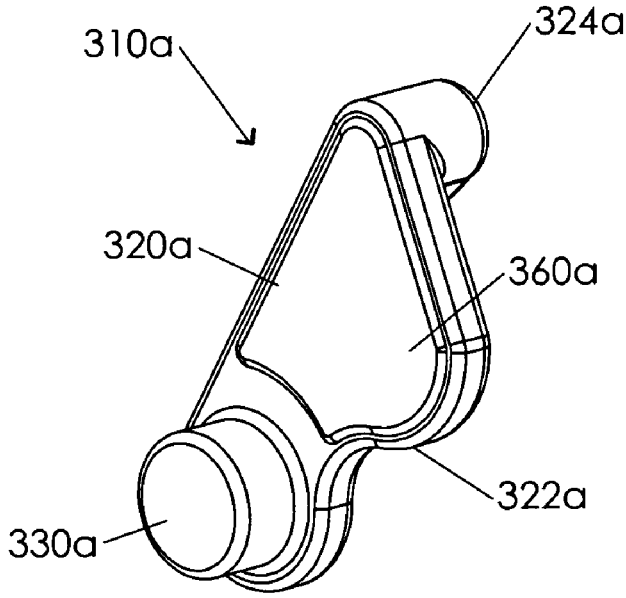
FIG. 9*b* is a perspective view of FIG. 9*a* from an opposite side.
Figure 9C:
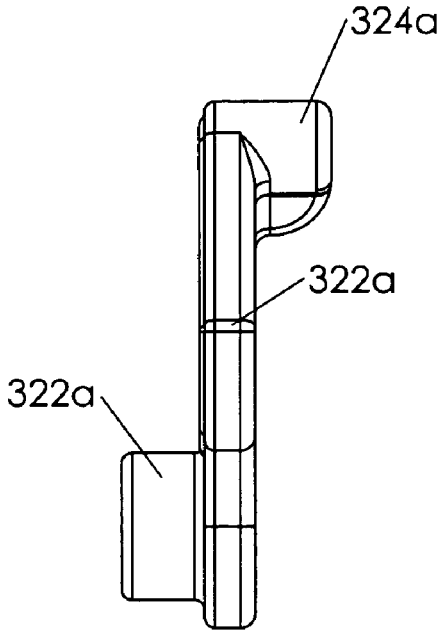
FIG. 9*c* is a side view of the linkage of FIG. 9*b*.
Figure 10A:
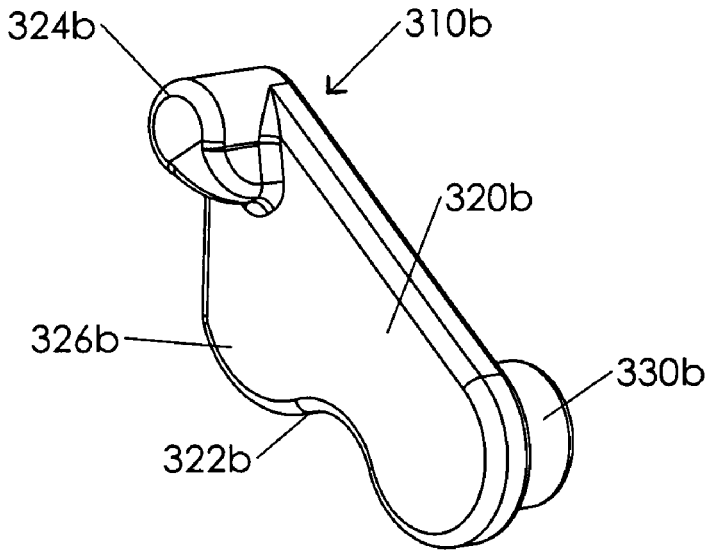
FIG. 10*a* is a perspective view of a secondary cam or linkage according to an example embodiment of the present invention.
Figure 10B:
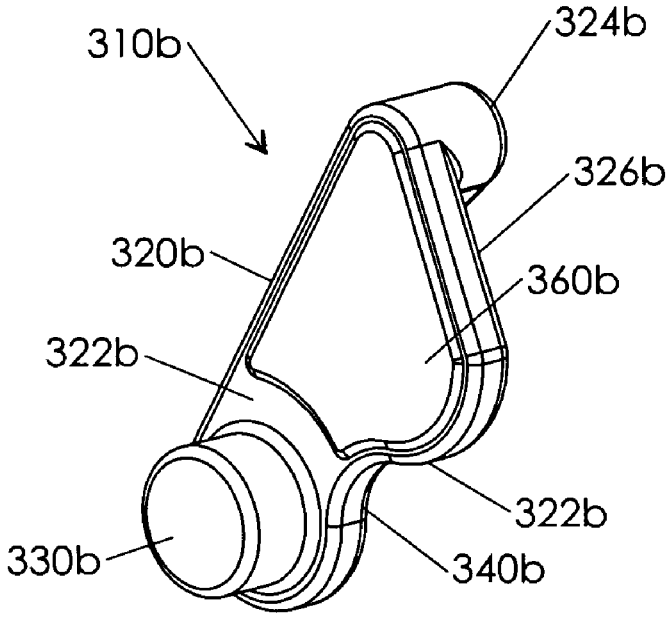
FIG. 10*b* is a perspective view of the secondary cam or linkage of FIG. 10*a* from an opposite side.

When body portion 240 is generally cylindrical in shape, as particularly illustrated in FIGS. 8*a* and 8*b*, an outer surface 244 of body portion 240 can have a linkage receiving portion, channel or groove 246 formed therein for receiving a portion of linkages 310*a* and/or 310*b* when bolt 101 is in the retracted position. Body portion 240 can have multiple linkage receiving portions or grooves disposed about its outer surface 244 to receive either the first 310*a* or second 310*b* linkages depending upon the direction of rotation of primary cam 210. Additionally, the multiple linkage receiving portions or channels can be on opposite sides of arm 242 to accommodate linkages 310*a* and 310*b* being disposed on opposite sides of primary cam 210.

Referring to FIGS. 6-8B, body portion 240 can also include a clearance section, groove or depression 241 extending generally about a portion thereof. The clearance sections 241*a* and/or 241*b* permits free rotation of primary cam 210 between leg portions 232*a* and 232*b* of bolt 101. In particular, leg portions 232*a* and 232*b* each can include a step or elevated portion 243*a* and 243*b* for adding strength thereto. Upon rotation of primary cam 210 clearance sections 241*a* and/or 241*b* rotate adjacent, over or near step portions 243*a* and 243*b* respectively.

Primary cam 210, although not illustrated, is operatively couplable to a handle or handle-spindle assembly that is used to pivot or rotate primary cam 210 and concomitantly linkages 310*a* and/or 310*b*. In one example embodiment, at least one handle or spindle bore 248 extends into and/or through body portion 240 of primary cam 210 for receiving the handle or handle-spindle assembly. Spindle bore 248 can have any cross sectional shape corresponding to a cross section of the handle or handle-spindle assembly. When primary cam 210 is disposed between housing 102 and cover 120, as illustrated in FIGS. 1 and 2, spindle bore 248 is in registration with cam openings 220*a* and 220*b* extending through housing 102 and cover 120 respectively. Cam openings 220*a* and 220*b*, along with spindle bore 248 are all in registration with an opening extending through the door to permit operative coupling of the handle or handle-spindle assembly with primary cam 210

As particularly illustrated in FIGS. 1-2 and 8*a*-8*b*, primary cam 210 can be rotatably or pivotally suspended or disposed between housing 102 and cover 120 to permit operative engagement with linkages 310*a* and/or 310*b*. As particularly illustrated in FIGS. 8*a*-8*b*, primary cam 210 can have a housing bearing surface 250 and a cover bearing surface 252 formed on body portion 240 for confronting edge surfaces defining cam openings 220*a* and 220*b*. In one example embodiment, bearings can be disposed on bearing surfaces 250 and 252 to facilitate rotation or pivoting of primary cam 210.

Turning now to arm portion 242, and particularly to FIGS. 1 and 8*a*-8*b*, it is notable that a width of arm portion 242 can taper toward a free end 254 thereof for reducing the amount of space needed in the interior 104 of housing 102. Additionally, free end 254 can include a pair of axially disposed protuberances 256*a* and 256*b* extending oppositely away from each other and generally perpendicularly away from a long axis thereof for operatively confronting at least one of linkages 310*a* or 310*b*. The axial disposition of protuberances 256*a* and 256*b* with respect to each other and arm portion 242 ensures proper engagement with either of linkages 310*a* and 310*b* depending upon rotation of the handle and primary cam in either the clockwise or counterclockwise direction. In a preferred example embodiment, engagement between arm portion 242 of primary cam 210 with either of linkages 310*a* and 310*b* is enough to draw bolt 101 from the extended position toward the retracted position.

Referring now to FIGS. 3 and 9*a*-10*b*, linkages 310*a* and 310*b* are pivotally coupled to or in housing 102 and cover 120 respectively with primary cam 210 disposed therebetween. Linkages 310*a* and 310*b* comprise a blade or body portion 320*a* and 320*b* having a generally curved or arcuate peripheral edge or profile 322*a* and 322*b* that generally faces toward face plate 130. A peg portion 324*a* and 324*b* or like structure extends generally perpendicularly away from a first surface 326*a* of blade portion 320*a* and a first surface 326*b* of blade portion 320*b* to engage a linkage notch 328*a* and 328*b* (see FIGS. 6 and 7) formed in each of spaced leg portions 232*a* and 232*b* respectively. As particularly illustrated in FIGS. 6 and 7, linkage notch 328*a* is formed in a rear surface of bolt 101 that faces or is adjacent to housing 102 while linkage notch 328*b* extends into a front surface of bolt 101 that faces or is adjacent to cover 120. As illustrated in FIG. 3, peg portions 324*a* and 324*b* of linkages 310*a* and 310*b*, respectively, extend toward or in the direction of primary cam 210 and engage linkage notches 328*a* and 328*b*.

Linkages 310*a* and 310*b* are pivotally coupled to housing 102 and cover 120 by a post 330*a* and 330*b* that extends from a generally opposite second surface 332*a* and 332*b* of body portions 320*a* and 320*b* respectively. Post 330*a* of linkage 310*a* is pivotally disposable in a linkage opening 334*a* extending into housing 102 (see FIG. 3) while post 330*b* of linkage 310*b* is pivotally disposable in a linkage opening 334*b* extending into cover 120 (see FIG. 3). Linkages 310*a* and 310*b* can also be coupled to housing 102 and cover 210 respectively by other means such as screws, bolts, and the like.

Referring to FIGS. 9*a*-9*c* and 10*a*-10*b*, linkages 310*a* and 310*b* have flared or expanded portions 360*a* and 360*b* proximate pegs 324*a* and 324*b*. The flared portions 360*a* and 360*b* create the undulating peripheral edges 322*a* and 322*b* respectively. Flared portions 360*a* and 360*b* facilitate the increased rate at which linkages 310*a* and 310*b* pivot thereby directly increasing the rate of retraction of bolt 101 into housing 102. In general, the greater the flaring of flared portions 360*a* and 360*b*, the greater the rate of pivoting of linkages 310*a* and 310*b* and the greater the rate of retraction for bolt 101.

Figure 11:
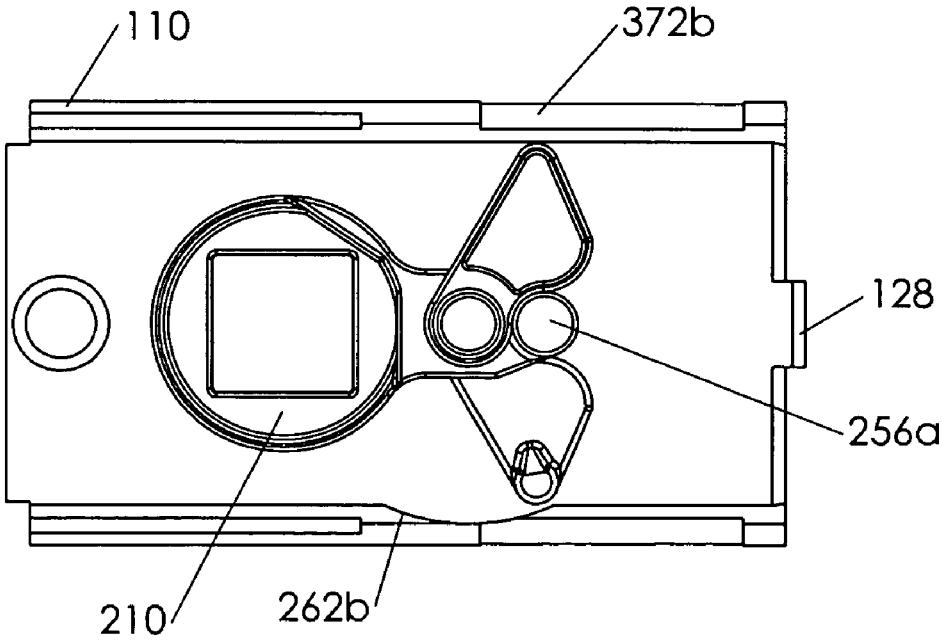
FIG. 11 is a side plan view of the primary cam and first and second linkages disposed in the cover according to an example embodiment of the present invention.
Figure 12:
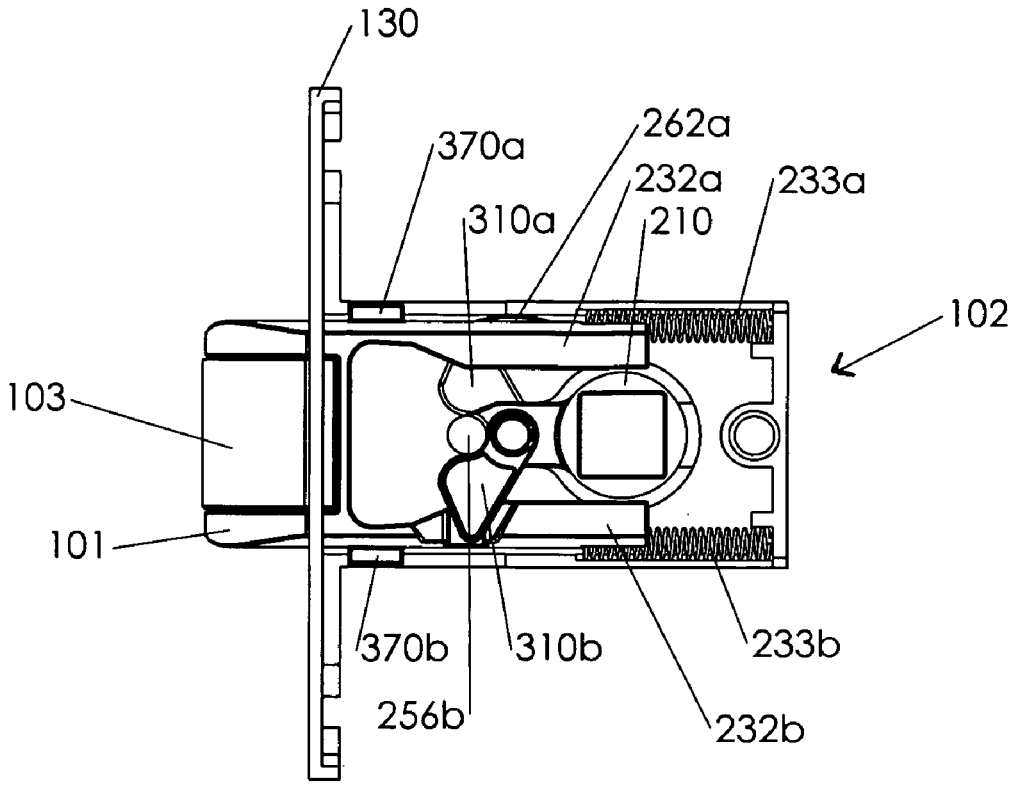
FIG. 12 is a side plan view illustrating a bolt in an extended position and in operative communication with the housing, primary cam and the first and second linkages according to an example embodiment of the present invention.

The following discussion of the use of example embodiments will assist the reader in understanding all of the novel features of the invention. Referring to the example use illustrated in FIGS. 11-14, primary cam 210 and linkages 310*a* and 310*b* each travel along arcuate paths as linkages 310*a* and 310*b* retract bolt 101 from the extended position toward the retracted position. When bolt 101 is in the extended position, as illustrated in FIGS. 11 and 12, protuberances 256*a* and 256*b* are axially aligned with a long axis of housing 102 and cover 120. Additionally, in the extended position, protuberances 256*a* and 256*b* are disposed in a seat section 340*a* and 340*b* formed in the undulating peripheral edges 322*a* and 322*b* (see FIGS. 9*a*-9*c* and 10*a*-10*b*) of linkages 310*a* and 310*b*. While in seat sections 340*a* and 340*b* protuberances 256*a* and 256*b* are proximate posts 330*a* and 330*b*.

As the handle or handle-spindle assembly is rotated, primary cam 210 and arm portion 242 are pivoted or rotated. Rotation of primary cam 210 in a first direction, indicated by the arrow A in FIG. 13, causes arm portion 242 and protuberance 256*a* to travel upward along an arcuate path. While traveling along the arcuate path protuberance 256*a* continuously engages peripheral edge 322*a* of linkage 310*a*. Rotation of primary cam 210 in a second direction, indicated by the arrow B in FIG. 14, causes arm portion 242 and protuberance 256*b* of primary cam 210 to travel in a downward arcuate path. While traveling along the downward arcuate path protuberance 256*b* continuously engages peripheral edge 322*b* of linkage 310*b*.

As either protuberance 256*a* or 256*b* travels along in the first or second direction, continuously engaging the undulating peripheral edge 322*a* or 322*b* they begin to engage the flared portion 360*a* or 360*b* of linkage 310*a* or 310*b*. As protuberance 256*a* or 256*b* engages flared portion 360*a* or 360*b* less rotation or pivoting of primary cam 210 translates into greater rotation or pivoting of linkage 310*a* or 310*b*. The differential between the amount of rotation or pivoting of primary cam 210 and linkage 310*a* or 310*b* permits linkage 310*a* or 310*b* to quickly retract bolt 101. The increased rate of retraction of bolt 101 also eliminates the need to have handle or handle-spindle assembly rotate a full 60 degrees in either the first or second direction. In one example embodiment, rotation of the handle or handle-spindle assembly approximately 22 degrees can fully retract bolt 101. However, one skilled in the art will understand after reading the above description that increasing or decreasing the amount of flaring of linkage 310*a* or 310*b* will vary the amount of rotation needed to fully retract bolt 101.

Figure 13:
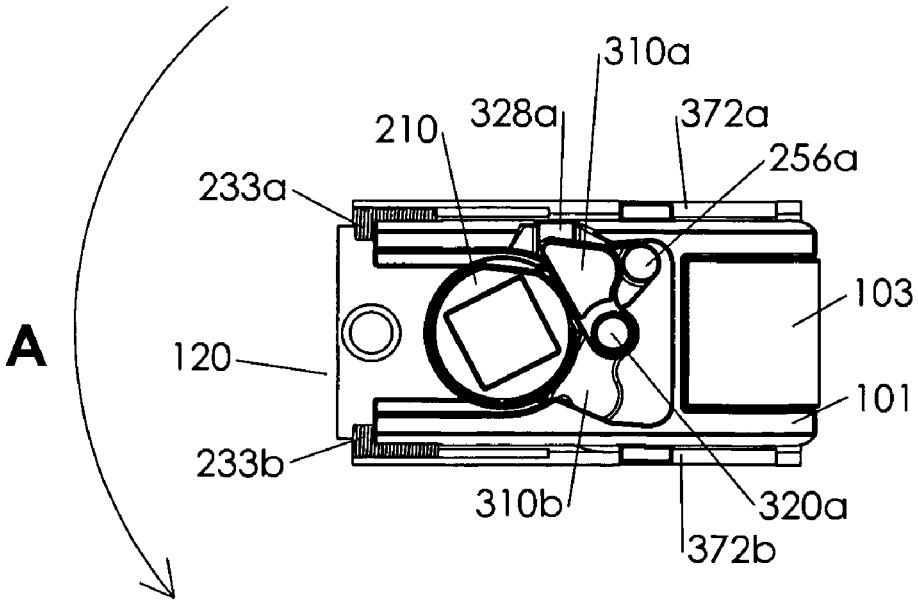
FIG. 13 is a side plan view of a bolt disposed proximate the cover and in operative communication to the primary cam and the first and second linkages. The bolt is illustrated in a retracted position according to an example embodiment of the present invention.
Figure 14:
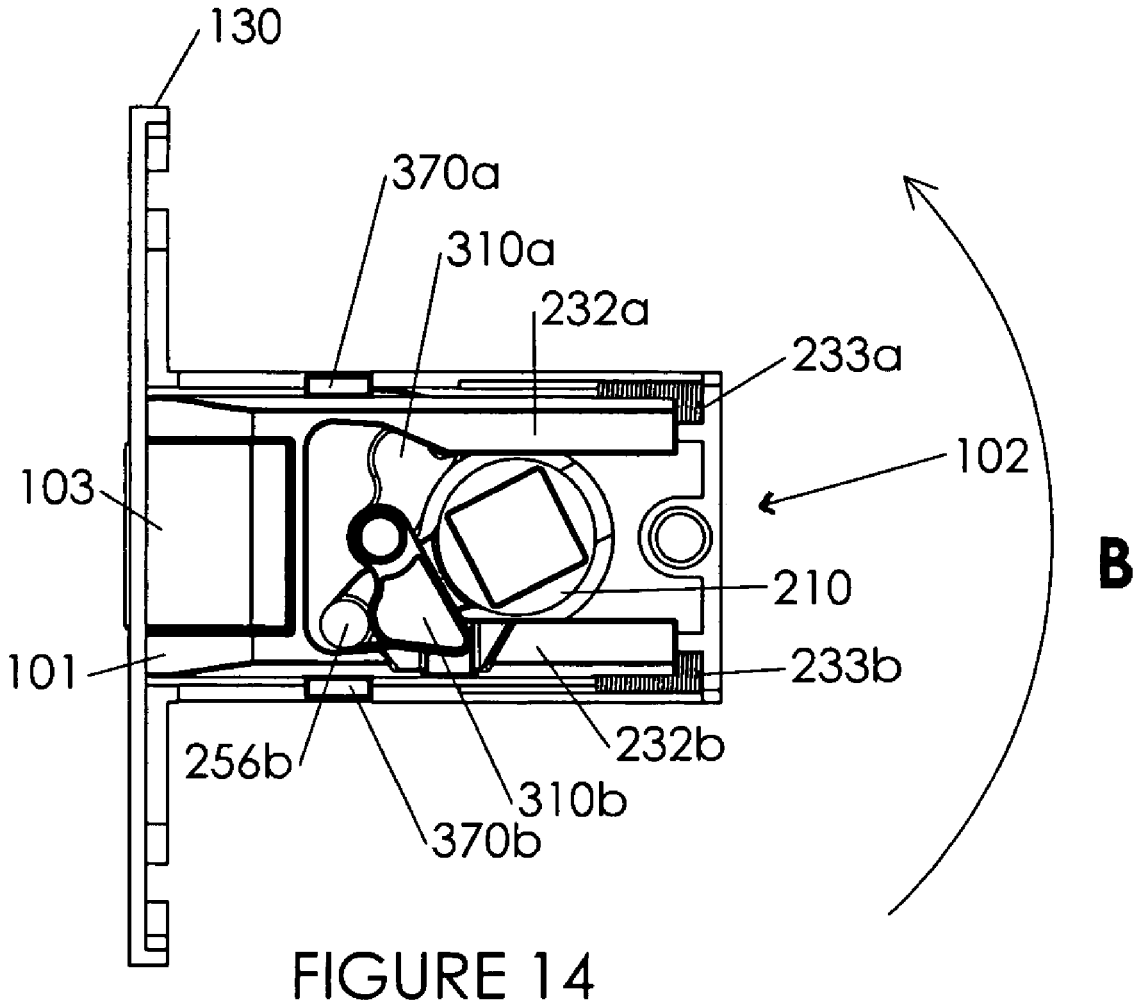
FIG. 14 is a side plan view of a bolt in a retracted position and in operative communication with the housing, primary cam and the first and second linkages according to an example embodiment of the present invention.

As illustrated in FIGS. 13 and 14, when bolt 101 is disposed in the retracted position both linkages 310*a* and 310*b* confront primary cam 210. Both linkages 310*a* and 310*b* are retracted regardless of the rotational direction of the handle or handle-spindle assembly due to the continuous engagement of pegs 324*a* and 324*b* of linkages 310*a* and 310*b* in linkage notches 328*a* and 328*b* of bolt 101. As illustrated in FIGS. 13 and 14, upon fully retracting bolt 101, pegs 324*a* or 324*b* begin to reach a descending section of the flared portion 360*a* or 360*b* of linkages 310*a* or 310*b*. Upon reaching the descending section the amount of displacement of linkages 310*a* or 310*b* by pegs 324*a* or 324*b* is reduced. As a result, less force and wear is exerted upon linkages 310*a* or 310*b*.

As illustrated in FIGS. 11 and 12, housing 102 and cover 120 can have depressions or recesses 262*a* and 262*b* extending into the top wall 108 and/or bottom wall 126 of housing 102 and cover 120 respectively for permitting passage of a tip or end of linkages 310*a* and 310*b* as bolt 101 moves between the extended and retracted positions. Lastly, bolt 101 can have at least one stop to limit the sliding movement of bolt 101 in housing 102 and cover 120. As illustrated in FIGS. 2 and 3, bolt 101 can have two stops 370*a* and 370*b*, each of which can extend from one of the leg portions 232*a* and 232*b* respectively or from opposed sides of the engagement portion 230. Stops 370*a* and 370*b* can travel in channels 372*a* and 372*b* formed in housing 102 and cover 120 respectively that when combined forms a slot 374. The ends 375 and 376 of slot 374 form abutment surfaces that limit or stop movement or sliding of bolt 101.

Once the door is utilized a user can release the handle allowing biasing members 233*a* and 233*b* to expand forcing bolt 101 from the retracted position toward the extended position. As bolt 101 moves toward the extended position linkages 310*a* and 310*b* are concurrently pivoted or rotated away from primary cam 210. As linkages 310*a* and 310*b* pivot away from primary cam 210 their peripheral edges 322*a* or 322*b* (depending upon initial direction of rotation of handle) engage protuberances 256*a* or 256*b*, and concurrently arm portion 242, until arm portion 242 comes to rest in seat sections 340*a* and 340*b* of linkages 310*a* and 310*b*. In the resting state the arm portion 242 of primary cam 210 is axially aligned with the longitudinal axis of housing 102 and cover 120 until a subsequent operation or actuation.

What is claimed is:

1. A quick cam latch mechanism comprising:

a housing;

a bolt disposed in the housing, the bolt being positionable between an extended position and a retracted position; and a cam assembly disposed in the housing and operatively coupled to the bolt, the cam assembly comprising a rotatable primary cam having an engagement arm with an engagement surface at one end, and first and second rotatably mounted linkages each having flared engagement surfaces, the linkages being mounted to the housing such that the flared surfaces of the linkages face each other with the entire engagement surface of the primary cam disposed between the flared surfaces of the linkages, such that upon rotation of the primary cam in a first direction, the engagement surface of the primary cam directly engages the flared engagement surface of the first linkage to directly cause the first linkage, but not directly cause the second linkage, to pivot about its axis in the first direction into direct engagement of the first linkage with the bolt so that the bolt is retracted from its extended position by rotation of the first linkage about its axis of rotation, and that upon rotation of the primary cam in a second direction, the engagement surface of the primary cam directly engages the flared surface of the second linkage to directly cause the second linkage, but not directly cause the first linkage, to pivot about its axis in the second direction into direct engagement of the second linkage with the bolt so that the bolt is retracted from its extended position by rotation of the second linkage about its axis of rotation; wherein each of the first and the second linkages pivot about a common axis of rotation.

2. The latch assembly of claim 1, further comprising a handle operatively coupled to the primary cam to actuate the cam assembly and retract the bolt into the housing.

3. The latch assembly of claim 1, wherein the cam assembly further comprises at least one biasing member disposed in the housing and operatively confronting at least a portion of the bolt, wherein the biasing member moves the bolt from the retracted position toward the extended position.

4. The latch assembly of claim 3, wherein the biasing member comprises a coiled spring.

5. The latch assembly of claim 1, wherein the bolt comprises a body portion and a pair of spaced parallel legs extending from one end of the body portion of the bolt.

6. The latch assembly of claim 5, wherein each leg of the bolt has a linkage engagement notch formed therein.

7. The latch assembly of claim 6, wherein the notches are transversely aligned with respect to a longitudinal axis of the bolt.

8. The latch assembly of claim 1, wherein the rotatable linkages have a post portion extending away therefrom pivotally coupling the rotatable linkages to the housing.

9. The latch assembly of claim 1, wherein each rotatable linkage has a peg portion extending into and operatively confronting a linkage notch formed in a portion of the bolt.

10. A latch assembly comprising:

a housing and a cover defining an interior of the housing;

a bolt slidably disposed in the interior of the housing, the bolt being positionable between an extended position and a retracted position;

a first linkage pivotally coupled by a first end to the housing, having a second outer end to engage the bolt, the first linkage having a flared surface defining an undulating peripheral edge;

a second linkage pivotally coupled by a first end to the housing, having a second outer end to engage the bolt, the second linkage having a flared surface defining an undulating peripheral edge, the first and second linkages being mounted to the housing with their flared surfaces facing each other;

a primary cam having an engagement arm with an engagement surface at a first end, rotationally mounted at a second end such that the engagement surface is entirely disposed between the flared surfaces of the first and second linkages, such that rotation of the primary cam in a first direction causes a surface of the primary cam to directly engage the flared surface of the first linkage directly directly causing the first linkage, but not directly causing the second linkage, to rotate in the first direction into direct engagement with the bolt so that the bolt is retracted from its extended position by rotation of the first linkage about its axis of rotation, and rotation of the primary cam in a second direction causes a surface of the primary cam directly to engage the flared surface of the second linkage directly causing the second linkage, but not directly causing the first linkage, to rotate in the second direction into direct engagement with the bolt so that the bolt is retracted from its extended position by rotation of the second linkage about its axis of rotation;

a handle rotatably coupled to the primary cam to rotate the primary cam in the first or second directions; wherein each of the first and the second linkages rotate about a common axis of rotation.

11. The latch assembly of claim 10, further comprising a biasing member disposed between the bolt and a portion of the housing to bias the bolt from the retracted position toward the extended position.

12. The latch assembly of claim 10, wherein the bolt has a body portion and a pair of parallel spaced legs extending from one end of the body portion of the bolt, and the first and second linkages operatively engage a corresponding leg.

13. The latch assembly of claim 12, wherein each of the spaced legs includes linkage notch for engaging the corresponding first or second linkage.

14. The latch assembly of claim 13, wherein the first and second linkages each have a peg portion for engaging a corresponding bolt linkage notch.

15. The latch assembly of claim 10, wherein the first linkage has a post extending away therefrom that is pivotally coupled to a portion of the housing, and the second linkage has a post extending away therefrom that is pivotally coupled to a portion of the cover.

* * * * *

UNITED STATES PATENT AND TRADEMARK OFFICE

CERTIFICATE OF CORRECTION

PATENT NO. : 7,703,815 B2
APPLICATION NO. : 11/177069
DATED : April 27, 2010
INVENTOR(S) : John K. Berkseth et al.

It is certified that error appears in the above-identified patent and that said Letters Patent is hereby corrected as shown below:

Column 9, line 18 (Claim 10) "directly directly causing the first linkage," should be -- directly causing the first linkage, --.

Signed and Sealed this
Twenty-fifth Day of December, 2012

David J. Kappos

David J. Kappos
*Director of the United States Patent and Trademark Office*